United States Patent [19]

Lanmon, II

[11] Patent Number: 4,577,687

[45] Date of Patent: Mar. 25, 1986

[54] CABLE HEAD CATCHER MECHANISM

[75] Inventor: C. P. Lanmon, II, Longview, Tex.

[73] Assignee: Hydrolex, Inc., Longview, Tex.

[21] Appl. No.: 583,864

[22] Filed: Feb. 27, 1984

[51] Int. Cl.[4] ..... E21B 33/072; E21B 23/000

[52] U.S. Cl. ..... 166/243; 166/385; 166/77

[58] Field of Search ..... 166/70, 92, 93, 97, 166/98, 99, 209, 211, 212, 214, 67, 84, 83, 382, 385, 77, 88, 75 R, 89, 90, 91

[56] References Cited

U.S. PATENT DOCUMENTS

| | | | |
|---|---|---|---|
| 2,440,015 | 4/1948 | Meddick | 166/83 |
| 2,616,504 | 11/1952 | Osmun | 166/83 X |
| 3,556,209 | 1/1971 | Reistle | 166/84 X |

*Primary Examiner*—Stephen J. Novosad
*Assistant Examiner*—David J. Bagnell
*Attorney, Agent, or Firm*—Gunn, Lee & Jackson

[57] ABSTRACT

A cable head catcher mechanism for use when running tools within a well and which catches the fishing neck of a wire line operated well tool in the event the wire line should become broken due to excessive force as the well tool reaches the upper limit of its travel within the well servicing apparatus. A segmented collet system within a pressure containing housing of the apparatus is operative to catch the fishing neck of a well tool to prevent the tool from falling in the event the wire line cable becomes broken. A sleeve piston is provided which operatively positions the segmented collet within the housing and is hydraulically energized to cause releasing movement of the collet to thus release the fishing neck of the well tool when desired. The mechanism is constructed to allow the cable head and cable to be installed without requiring cutting of the cable.

22 Claims, 6 Drawing Figures

CABLE HEAD CATCHER MECHANISM

FIELD OF THE INVENTION

This invention relates generally to well servicing operations by means of wire line tools and more specifically relates to apparatus which is enabled to catch the fishing neck of a well tool and establish a mechanically interlocking relation therewith which prevents the well tool from falling within the well in the event the wire line should become inadvertently broken as the well tool reaches the upper limit of its travel within the well.

BACKGROUND OF THE INVENTION

When wire line logging or perforating tools are introduced into wells that have surface pressure the tools are first placed inside a pipe system known as a lubricator which is attached to the well. The pressure tight lubricator tube is then pressured to the same pressure as the well, the well valve opened and the tool is then lowered into the well on the wire line to conduct its servicing operation. After the servicing operation has been completed, well servicing apparatus pulls upwardly on the wire line thus moving the servicing tool upwardly into the lubricator. After the well valve has been closed, well pressure is bled from the lubricator, after which the lubricator and tool are removed from the wellhead assembly.

During lubricator assembly and upon return of the tools from the well, the tools can be pulled against the internal stop of the lubricator system with sufficient force that the wire line cable can be accidently broken, thus releasing the tool. In the absence of a tool catching mechanism, the tool will fall to the lower portion of the well where it must then be retrieved by means of expensive and time consuming fishing operations. It is, of course, desirable to catch the tool string and to prevent it from falling downhole. Most cable heads are machined to provide a fishing neck that is intended for aiding recovery of tools lost downhole. The same fishing neck can be used to catch the cable head in the event the cable should become broken.

THE PRIOR ART

Various types of cable head catching equipment have been utilized in the past but have limitations that render them ineffective under some well conditions or well assembly conditions. One such fishing neck catching type well servicing tool is manufactured and sold by Texas Oil Tools, Inc., 10600 Shadowood, #303, Houston, Tex. 77043; such tools being identified as top catch tools.

SUMMARY OF THE INVENTION

It is therefore a primary feature of the present invention to provide a novel cable head catching type wire line servicing mechanism which has the facility for controllably releasing a cable head after it has been positively caught by the cable head catching mechanism. This is a positive release mechanism which pushes the cable head out of the catching mechanism.

It is another feature of the present invention to provide a novel wire line servicing mechanism wherein a cable head and cable may be installed through it without requiring cutting of the cable.

It is also a feature of this invention to provide a novel cable head catching head mechanism including a collet type fishing neck catcher which is installed and operated for absolute retention of the fishing neck of the wire line tool and is also a positive catch for receiving and for controllably releasing the fishing neck, such positions being controlled by a hydraulically energized operator in conjunction with spring energized collet positioning means.

Briefly, tool catcher type wire line service equipment is provided having a pressure containing housing forming a pressure containing chamber within which a wire line service tool is adapted to be received. A segmented collet is provided within the pressure containing housing and is operable to a contracted tool retaining position or a radially expanded tool releasing position responsive to positioning of a hydraulic operator which is also movably disposed within the pressure containing housing. The hydraulic operator is in the form of a sleeve piston having an internal positioning flange which engages outwardly extending flanges of the collet segments and thus forms a positioning stop for location of the collet within the housing. The collet is yieldably movable in an upward direction by an upwardly directed tool induced force which overcomes the downwardly directed force of a compression spring. This upward yielding of the collet is accompanied by cam energized radial expansion of the collet to permit the fishing neck of the tool to move into the collet. After the fishing neck of the tool has entered the collet, the compression spring will shift the collet downwardly to a position where radial expansion is restrained by appropriate internal wall structure of the housing. Should excessive force be applied to the wire line cable after the wire line tool has engaged a positive internal stop within the housing, thus causing failure of the wire line cable, the collet mechanism will establish a positive interlocking engagement with the fishing neck of the tool thus mechanically locking the tool in assembly with the wire line servicing mechanism and preventing the tool from falling down the well.

BRIEF DESCRIPTION OF THE DRAWINGS

So that the manner in which the above recited features, advantages and objects of the present invention will become apparent and can be understood in detail, more particular description of the invention, briefly summarized above, may be had by reference to the embodiment thereof which is illustrated in the appended drawings, which drawings form a part of this specification. It is to be noted however that the appended drawings illustrate only a typical embodiment of the invention and are, therefore, not to be considered limiting of its scope, for the invention may admit to other equally effective embodiments.

IN THE DRAWINGS

Figure 1:
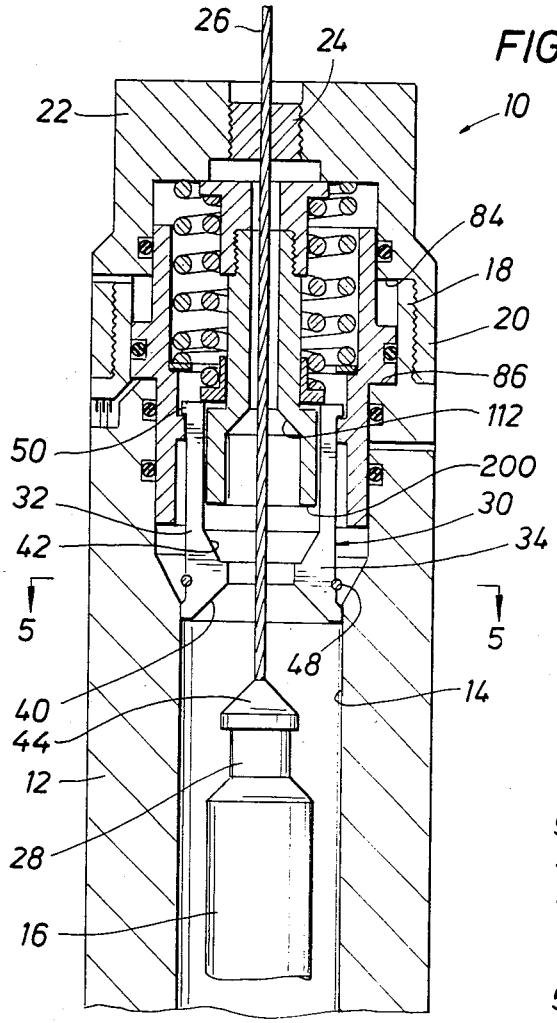
Figure 2:
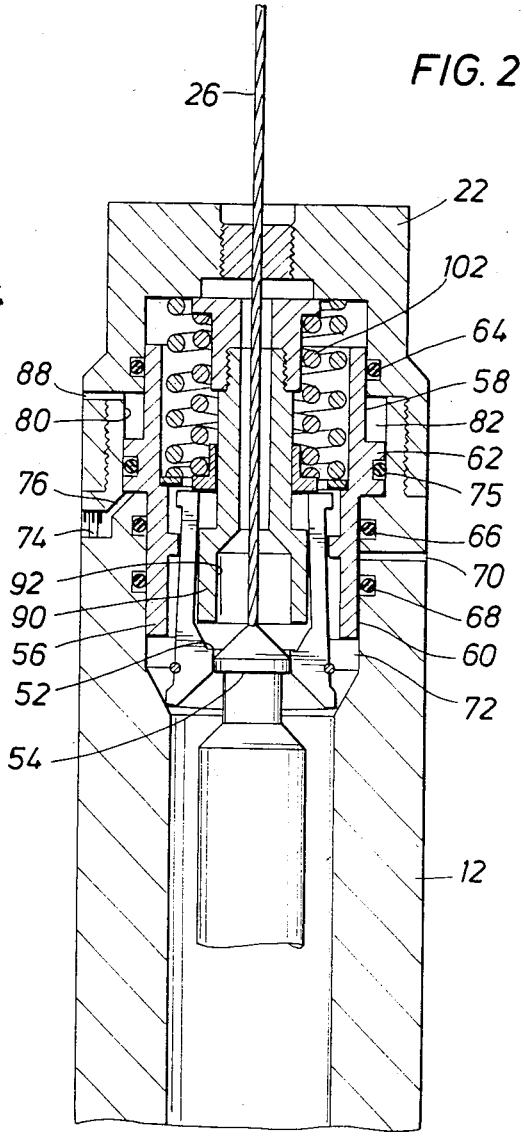
Figure 5:
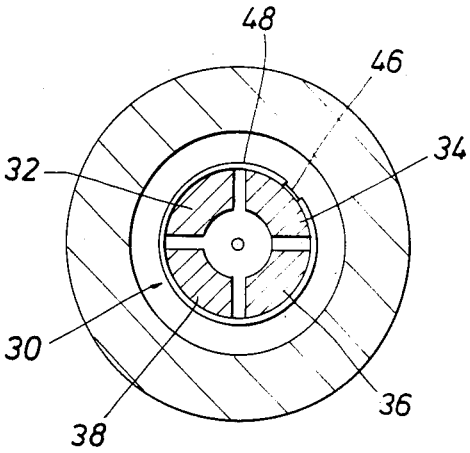
Figure 3:
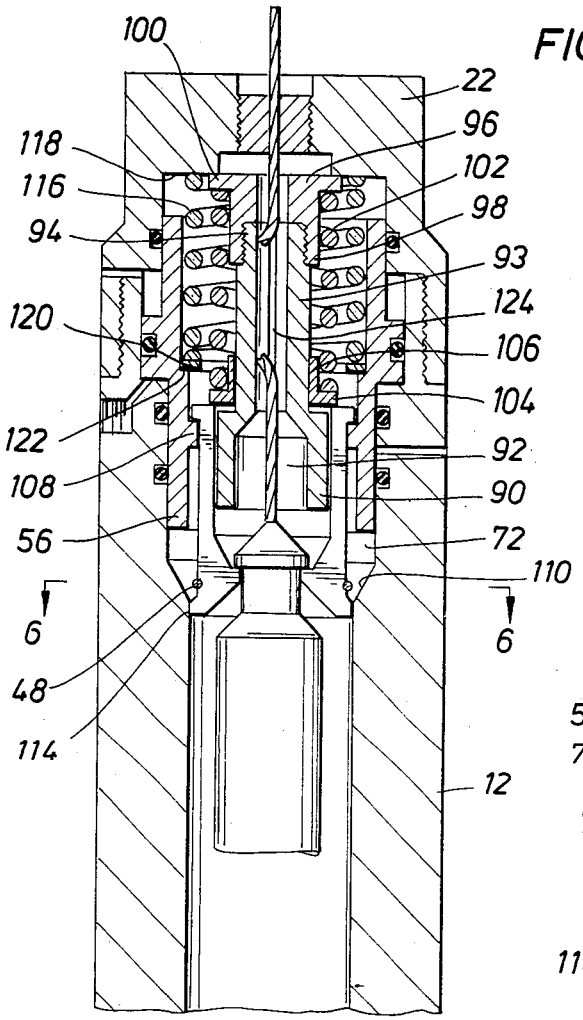
Figure 4:
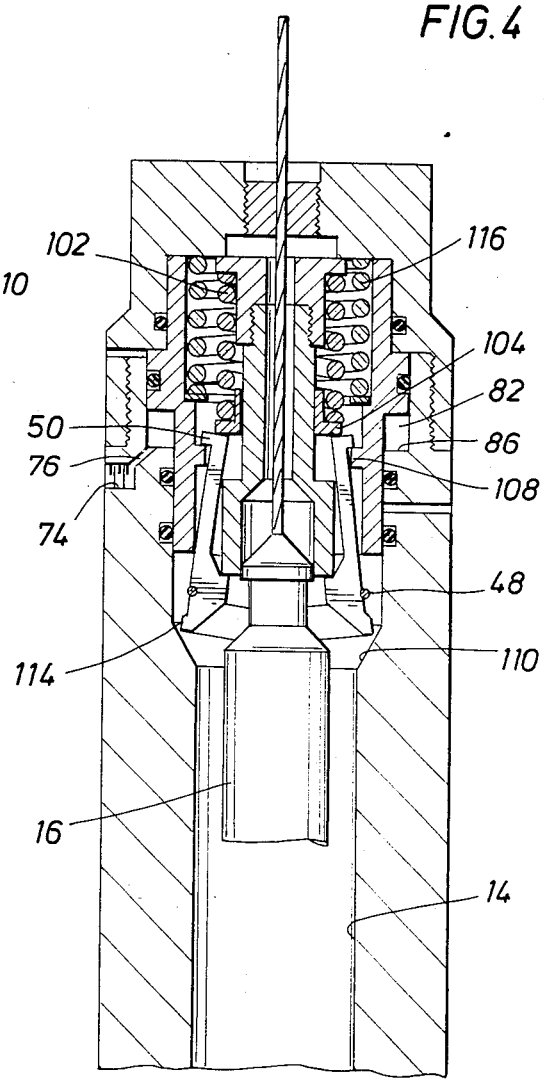
Figure 6:
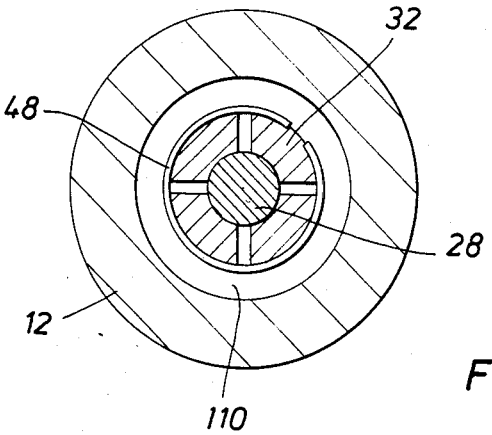

FIG. 1 is a sectional view of a cable head catcher mechanism constructed in accordance with the present invention and showing a wire line tool in close proximity below the cable head catcher mechanism which is disposed in its normal position;

FIG. 2 is a sectional view similar to that of FIG. 1 and showing the expanded position of the segmented collet as the fishing neck of the tool is forced upwardly into the collet;

FIG. 3 is also a sectional view similar to that of FIGS. 1 and 2, illustrating a broken wire line cable and showing the fishing neck of the tool being secured by the collet mechanism;

FIG. 4 is also a sectional view similar to that of FIGS. 1-3 illustrating the collet mechanism and hydraulic actuator mechanism positioned in the tool releasing positions thereof;

FIG. 5 is a transverse sectional view of the tool catcher mechanism taken along line 5—5 of FIG. 1; and FIG. 6 is a transverse sectional view taken along line 6—6 of FIG. 3.

DETAILED DESCRIPTION OF PREFERRED EMBODIMENT

Referring now to the drawings and first to FIG. 1, a wire line lubricator mechanism is illustrated generally at 10 having a pressure containing housing 12 defining a central passage 14 through which a wire line tool 16 passes during wire line service operations. The upper portion of the housing 12 is formed to define an upstanding externally threaded flange 18 which is received within an internally threaded connecting flange portion 20 of a housing closure 22. The housing closure is provided with a stuffing box 24 through which a wire line cable 26 passes in sealed relationship.

It is desirable to provide a wire line servicing mechanism incorporating a tool catcher enabling the mechanism to establish a mechanical positive locking relationship with the fishing neck 28 of the well servicing tool supported on the wire line cable. It is also desirable to provide for controlled releasing of the fishing neck of the tool in the event such is desirable without necessitating disassembly of the wire line servicing equipment. One suitable mechanism for catching and controllably releasing the fishing neck of a well service tool may conveniently take the form illustrated in FIGS. 1-6 wherein the structure shown includes a segmented collet assembly illustrated generally at 30. The collet assembly incorporates a plurality of collet segments such as shown at 32, 34, 36, and 38 particularly in FIG. 5. Each of the segments of the segmented collet assembly is of identical configuration, forming tapered cam surfaces 40 and 42 which react with the fishing neck of the tool and particularly with the frusto-conical cam surface 44, depending upon the direction of tool movement relative to the collet assembly. Each of the collet segments defines an external groove segment 46 shown particularly in FIG. 5 which groove segments cooperatively receive a garter spring 48 that functions to urge the collet segments radially inwardly toward the collapsed positions thereof. Each of the collet segments also defines an outwardly directed flange 50 to thus provide for controlled positioning of the collet assembly in the manner described hereinbelow.

As shown in FIG. 2 each of the collet segments also defines a tool catching shoulder segment 52, which shoulder segments are collectively disposed for restraining engagement with a downwardly directed catching surface or shoulder 54 of the fishing neck.

For controlled positioning of the collet assembly within the housing a hydraulically energized sleeve piston is provided which defines upper and lower cylindrical sealing surfaces 58 and 60 which are separated by an enlarged piston section 62. A circular sealing element 64, such as an O-ring or the like, is retained within a circular groove formed within the closure element 22 and establishes sealing engagement with the cylindrical outer surface 58 of the sleeve piston 56.

For the establishment of a seal between the housing 12 and the lower portion of the sleeve piston a pair of similar annular sealing elements 66 and 68 establish sealed engagement with the lower cylindrical surface 60 of the sleeve piston. The O-ring type sealing elements 66 and 68 are disposed in spaced relation and are retained within circular seal grooves formed internally of the housing structure 12. The sealing elements 66 and 68 are positioned on opposite sides of a vent passage 70 which vents well pressure from the piston chamber 72 in the event the seal 68 should leak. This feature protects the hydraulic system of the mechanism in the manner described hereinbelow.

Sealing element 64 is of slightly larger diameter as compared to piston seal 68, thus causing well pressure induced force acting on unbalanced surface areas of the sleeve piston to develop a downwardly directed resultant force which aids the piston return spring in shifting the piston downwardly to its FIG. 1 position.

For controlled operation of the sleeve piston 56 the body structure 12 is formed to define an internally threaded opening 74 enabling a hydraulic line to be threadedly connected to the housing. The internally threaded opening 74 is in communication with a hydraulic supply passage 76, permitting hydraulic fluid to be injected into the piston chamber immediately below the intermediate piston section 62. The piston section 62 is externally grooved and is provided with a circular piston seal 78, such as an O-ring or the like, which establishes a seal with the internal cylindrical surface 80 which is defined by the upstanding body connector flange 18. The piston chamber 82, between the downwardly directed stop shoulder 84 and the upwardly directed stop shoulder 86 of the housing, is vented by means of a vent passage 88, thus enabling unrestrained piston movement responsive to the pressure of hydraulic fluid injected into the piston chamber through the fluid supply passage 76.

Since the internal passage of the housing 12 may be under well pressure significantly higher than can be withstood safely by the hydraulic system connected at the threaded opening 74, the spaced sealing elements 66 and 68 with the vent 70 disposed therebetween provide efficient protection for the hydraulic supply system. Should the lower piston seals leak, it is necessary to ensure that well pressure is not communicated to the hydraulic system. In the event the O-ring 68 should leak, pressure from the piston chamber 72 will be vented, thus not only providing indication of seal leakage but also preventing the pressure from reaching the hydraulic system connected at the threaded opening 74. Further, it should be noted that the outer piston surface 58 is of slightly larger dimension as compared to the cylindrical surface 60 at the lower extremity of the sleeve piston. This feature provides a slightly greater surface area at the upper extremity of the piston which is exposed to well pressure, thus inducing a downwardly directed resultant force on the sleeve piston tending to urge it to the position shown in FIGS. 1 and 2. In the event the upper sealing element 64 should leak, well pressure bypassing the seal and entering the upper piston chamber 82 will be vented via vent passage 88. In the event of seal leakage, therefore, the mechanism will provide a visual indication of which piston seal is leaking, thereby enabling operating personnel to take appropriate measures to ensure the safety of personnel assisting in wire line servicing operations.

A cable head stop is provided as shown at 90, forming an internal receptacle 92 which is adapted to receive the fishing neck 28 of the well service tool. The head stop 90 is of elongated form defining an elongated spring guide portion 93 which is provided with an externally threaded portion 94 at its upper extremity as described particularly in connection with FIG. 3. A spring retainer element 96 is provided having an internally threaded portion 98 which receives the upper externally threaded extremity of the head stop. The spring retainer 96 defines a circular thrust shoulder 100 against which is seated the upper end of a collet positioning spring 102. The lower end of the spring 102 bears against a circular thrust shoulder 104 of a collet thruster element 106 which is in the form of a ring surrounding the elongated guide portion 93 of the head stop. The collet thruster 106 is urged downwardly by the compression spring 102 and bears against the upper extremities of the collet segments, thus forcing the collet assembly downwardly, in turn urging the collet positioning flanges 50 downwardly.

The sleeve piston is provided with an internal positioning flange 108 defining an upwardly directed stop shoulder which is engaged by the positioning flanges 50 of each of the collet segments. Thus, the collet assembly is ordinarily maintained in engaged, cooperatively movable relation with the sleeve piston 56. As the fishing neck of the well service tool is moved upwardly by the wire line 26 however, the collet assembly will be positioned as shown in FIG. 1. The conical upper surface 44 of the cable head portion of the fishing neck will engage the downwardly directed cam surfaces 40 of the collet segments, thereby applying an upwardly directed force to the collet assembly. Since in the FIG. 1 position of the mechanism the collet assembly is restrained against radial movement by the cylindrical surface 14 defining the passage of the housing, the collet assembly must first be moved upwardly by a limited distance before radial expansion of the collet may take place. The tapered cam surface 100, defining the lower extremity of the piston chamber, will permit gradual radial expansion of the collet assembly against the force of the garter spring 48 as the collet assembly is forced upwardly against the compression of the collet positioning spring 102. As soon as sufficient radial expansion of the collet assembly has taken place to allow the cable head 44 of the fishing neck to pass into the collet, i.e. the position shown in FIG. 2, further upward movement of the collet assembly will be resisted by the compression spring 102 as the fishing neck clears the shoulder surface 52 of the segments. The collet positioning spring will shift the collet segments downwardly to the positions shown in FIG. 1 or 3. The internal cam surface 110 of the housing 12 guides the lower ends of the segments into the internal passage 14 to thus prevent radial expansion of the collet assembly. The cable head will continue its upward movement into the receptacle 92 of the head stop. Upward movement of the fishing neck will cease as the tapered surface 44 of the cable head engages the downwardly directed conical surface 112 within the head stop receptacle.

With the cable head within the receptacle, excessive upward force on the wire line 26 can cause the wire line to break or separate from the cable head such as shown in FIG. 3. In this event, the wire line tool 16 will fall downwardly causing the catching surface 54 of the fishing neck to engage the upwardly directed stop shoulders 52 of each of the collet segments as shown in FIG. 3. Thus, even though the wire line has become broken, the fishing neck of the servicing tool is caught and retained by the segmented collet assembly. In the FIG. 3 position lower flanges 114 of each of the collet segments will be in engagement with the internal cylindrical surface 14, thereby preventing radial expansion of the collet assembly. Since the collet assembly is prevented from expanding in its FIG. 3 postion, the fishing neck of the well tool 16 will be efficiently and positively retained, thus preventing the tool from falling to the bottom of the well.

Within the piston chamber 72 of the housing 12 is provided a piston return spring 116 which is a coil spring surrounding the collet positioning spring 102. The upper extremity of the spring 116 bears against a stop surface 118 formed by the housing closure 22. The lower end of the spring 116 bears against a circular spring stop element 120 which is in turn seated against the internal thrust shoulder 122 formed within the sleeve piston 56. Upward movement of the sleeve piston responsive to hydraulic pressure moves the piston against the compression of the piston return spring 116. Upon dissipation of hydraulic pressure below the piston seal 78 the downwardly directed force of the return spring 116 will shift the piston downwardly, expelling any hydraulic fluid from the piston chamber until the piston enlargement moves into contact with the piston stop surface 86. In this condition the sleeve piston will be located as shown in FIGS. 1, 2 and 3.

It is desirable to achieve controlled release of a caught service tool without necessitating disassembly of the apparatus. Accordingly the invention includes a hydraulically controlled collet releasing mechanism which may be simply referred to as a collet operator. As shown in FIG. 4, hydraulic pressure is injected into the piston chamber 82 through a hydraulic supply pipe connected at the threaded opening 74 and through supply passage 76. This causes the sleeve piston to be driven upwardly against the compression of the piston return spring 116. As described above, the internal piston flange 108 within the sleeve piston imparts an upwardly directed driving force against the positioning flanges 50 of each of the collet segments during upward piston movement. The collet segments in turn transmit an upwardly directed force against the collet positioning and return spring 102 through the collet thruster 104. The piston will move the collet assembly upwardly, also moving the tool 16 upwardly until the tapered cam surfaces 42 come into engagement with the lower extremity 200 of the head stop 90. Thereafter, continued upward movement of the collet assembly by the sleeve piston will result in camming activity which induces radial expansion of the lower portion of the collet assembly. Since at this time the lower flanges 114 of the collet segments will have been withdrawn from restraining engagement within the cylindrical passage 14, the camming activity will cause radial expansion of the collet assembly. After sufficient radial expansion of the collet assembly, the shoulders 52 will have been withdrawn from restraining engagement with the fishing neck catching surface 54, thereby releasing the fishing neck as shown in FIG. 4. The upwardly directed catching surfaces 52 of the collet segments are, therefore, extracted from engaging relation with the downwardly directed catching surface 54 of the cable head. The cable head of the fishing head is therefore released, allowing the tool 16 to fall downwardly within the passage 14 in the event such as desired.

After the fishing neck has been released in this manner, hydraulic pressure is dissipated from the piston chamber 82, thereby causing the compression spring 116 to return the sleeve piston to its fully seated position against the piston stop shoulder 86. The collet return spring 102 will shift the collet assembly downwardly toward the position shown in FIGS. 1 and 3. During this downward movement of the collet assembly, the tapered cam surface 110 will be engaged by the lower extremities of the collet segments, thereby positively camming or guiding the collet segments to the fully collapsed positions thereof, thus allowing the shoulders 114 of the collet segments to enter the upper portion of the cylindrical passage 114. The garter spring 48 adds to collet assembly collapse through its continuous application of forces thereto. When this occurs, the collet assembly is positioned as shown in FIGS. 1 and 3.

To provide for installation of a well servicing tool without necessitating cutting of the wire line cable, the spring retainer 96, the cable head stop 90, and the thruster 104 are radially slotted as shown at 124 in FIG. 3 to permit the cable to be inserted transversely through the slot into the central passages 125. The tool will pass vertically through the central openings of the large springs 102 and 116 and the cable is insertable between the collet segments. The slots 124 are not shown in the other Figures for the purpose of simplicity.

From the foregoing, it is readily apparent that a catcher type wire line service mechanism has been provided which functions to efficiently catch the fishing neck of a well service tool, thus retaining the service tool in positively secured relation therewith even though the wire line cable may become broken as the tool is forced to the upper extent of its travel upon being retrieved. The mechanism also provides for efficient release of the caught well service tool in the event such is desirable without necessitating disassembly of the apparatus. The compression spring bearing against the collet assembly will have sufficient downwardly directed force that a substantial upward force will be required before the collet assembly is moved upwardly against the force of the compression spring 102. This feature prevents the fishing neck of the service tool from being inadvertently caught during normal procedures that apply a small but safe pull on the wire line cable. As soon as the fishing neck of the tool enters the collet mechanism however the collet will become repositioned by the collet return spring, thereby permitting the wire line cable to fail without any possibility of losing the service tool down the well. Since the housing structure restricts the collet from expanding at the normal collet position, the fishing neck of the tool will be positively caught or interconnected with the collet assembly and therefore cannot be released until the collet assembly is controllably expanded to its tool release postion by the hydraulically energized piston.

The apparatus also effectively prevents introduction of well pressure into the hydraulic operator system and provides for pressure enhanced shifting of the hydraulic operator piston to the normal, fully downward and radially locked position thereof. Further, in the event of seal leakage, any pressure leaking past the seals will be vented to the atmosphere to provide a direct indication of seal leakage and to protect the hydraulic system from the effects of well pressure.

Thus, the present invention is one well adapted to attain all of the features hereinabove set forth, together with other features which are inherent in the apparatus itself. The scope of this invention is determined by the claims which follow.

What is claimed is:

1. A cable head catcher mechanism for establishing releasable latching engagement with a fishing neck of a cable supported well tool to provide structural support preventing downward movement of the fishing neck and well tool, comprising:

(a) housing means defining a passage through which a wire line cable of the well tool is capable of extending;

(b) collet means being disposed within said housing means and being radially yieldable to permit upward passage of the fishing neck of the well tool into said collet means, said collet means defining catching shoulder means for engagement with a catching surface of said fishing neck;

(c) means positioning said collet means at a radially restrained position within said housing means and being yieldable to permit movement of said collet means to expanded fishing neck receiving and releasing positions within said housing means; and (d) operator means being linearly movable within said housing means for selectively moving said segmented collet means linearly to a position inducing radial expansion of said collet means to the releasing position thereof for selective release of the fishing neck therefrom.

2. A cable head catcher mechanism as recited in claim 1, wherein said means positioning said collet means at said radially restrained position comprises:

first urging means applying a downwardly directed force to said segmented collet means.

3. A cable head catcher mechanism as recited in claim 2, wherein:

second urging means is disposed within said housing means and imparts a downwardly directed force to said operator means.

4. A cable head catcher mechanism as recited in claim 2, wherein:

(a) a head stop element is disposed within said housing means and limits upward movement of said fishing neck within said housing;

(b) thruster means is movably guided by said head stop element;

(c) said first urging means imparts a downwardly directed force to said thruster means; and (d) said thruster means is in engagement with said segmented collet means and transmits the force of said first urging means to said segmented collet.

5. A cable head catcher mechanism as recited in claim 4, wherein:

said head stop element and thruster means are slotted permitting transverse insertion of the wire line cable to the operative position thereof without requiring cutting of said cable.

6. A cable head catcher mechanism as recited in claim 1, wherein:

(a) collet expansion means is positioned within said housing means; and (b) said collet means form cam surface means, upon upward linear movement of said collet means said cam surface means is moved into camming engagement with said collet expansion means, resulting in radial expansion of said collet means toward said releasing position thereof.

7. A cable head catcher mechanism as recited in claim 6, wherein:

said housing means defines second cam surface means, upon downward linear movement of said collet means within said housing said collet means is moved into engagement with said second cam surface means resulting in radial contraction of said collet means toward the cable head catching position thereof.

8. A cable head catcher mechanism as recited in claim 1, wherein:

said operator means is hydraulically operable to achieve upward linear movement thereof within said housing means.

9. A cable head catcher mechanism as recited claim 1, wherein:

said collet operator means is a sleeve piston, being linearly movable in an upward direction by controllably introduced pressurized hydraulic fluid.

10. A cable head catcher mechanism as recited in claim 1, wherein:

said operator means defines unbalanced surface areas exposed to well pressure causing well pressure acting thereon to develop a resultant force acting on said operator means and tending to shift said operator means to the fishing neck receiving position thereof.

11. A cable head catcher mechanism for establishing releasable latching engagement with a fishing neck of a cable supported well tool to provide structural support preventing downward movement of the fishing neck and well tool, comprising:

(a) housing means defining a passage through which the wire line cable of the well tool is capable of extending;

(b) segmented collet means being disposed within said housing means and being linearly movable within said housing means and radially yieldable to permit upward passage of the fishing neck of the well tool into said collet means, said collet means defining catching shoulder means for restraining engagement with said fishing neck;

(c) first urging means yieldably positioning said collet means at a radially restrained position within said housing means and being yieldable responsive to tool induced force to permit movement of said collet means to fishing neck receiving position within said housing means;

(d) hydraulic piston means being movably disposed within said housing means and cooperating with said housing means to define a hydraulic chamber in communication with hydraulic fluid supply passage means formed by said housing means said hydraulic piston means being linearly movable to a collet expanding cable head release position;

(e) second urging means acting on said hydraulic piston means and applying a force tending to shift said hydraulic piston means linearly toward the fishing neck receiving position thereof;

(f) interengaging means on said piston means and said collet means permitting piston induced movement of said collet means against the force of said first urging means;

(g) collet expansion means disposed within said housing; and (h) said collet expansion means and said collet means cooperating during linear movement of said collet means to induce radial expansion of said collet means for release of said fishing neck, said collet means and said housing means cooperating during opposite linear movement of said collet means to induce radial contraction of said collet means to said fishing neck receiving position thereof.

12. A cable head catcher mechanism as recited in claim 11, wherein:

(a) said collet expansion means is a cable head stop positioned within said housing; and (b) said collet means defines cam surface means positioned for camming engagement with said cable head stop inducing said radial expansion of said collet means.

13. A cable head catcher mechanism as recited in claim 12, wherein:

said housing means forms second cam surface means positioned for camming engagement by said collet means inducing said radial contraction of said collet means.

14. A cable head catcher mechanism as recited in claim 11, wherein:

said first and second urging means comprise compression springs.

15. A cable head catcher mechanism as recited in claim 14, wherein:

said first and second compression springs are positioned in concentrically oriented relation.

16. A cable head catcher mechanism as recited in claim 11, wherein:

(a) said piston means is a sleeve piston being linearly movable within said housing means responsive to hydraulic fluid pressure; and (b) said second urging means is a compression spring urging said sleeve piston downwardly toward the tool receiving position thereof.

17. A cable head catcher mechanism as recited in claim 16, wherein:

vent means is provided in said housing means and vents well pressure from said housing means in the event of piston seal leakage thus protecting the hydraulic system of said piston from well pressure.

18. A cable head catcher mechanism as recited in claim 17, wherein:

internal parts of said mechanism through which said wire line cable extends and being of smaller dimension than the dimension of said well tool are slotted to permit transverse insertion of said wire line cable therein without requiring cutting of said cable.

19. A cable head catcher mechanism as recited in claim 16, wherein:

said sleeve piston is sealed with respect to said housing means by first and second seal means, one of said first and second seal means is of larger diameter developing unbalanced pressure responsive piston areas, well pressure acting on said unbalanced piston areas developing a resultant force urging said sleeve piston toward the tool receiving position thereof.

20. A cable head catcher mechanism as recited in claim 11, wherein:

(a) collet expansion means is positioned within said housing means; and (b) said collet means form cam surface means, upon upward linear movement of said collet means said cam surface means is moved into camming engagement with said collet expansion means, resulting in radial expansion of said collet means toward said releasing position thereof.

21. A cable head catcher mechanism as recited in claim 20, wherein:

said housing means defines second cam surface means, upon downward linear movement of said collet means within said housing said collet means is moved into engagement with said second cam surface means resulting in radial contraction of said collet means toward the cable head catching position thereof.

22. A cable head catcher mechanism as recited in claim 11, wherein:

said second urging means permits independent linear movement of said collet means responsive to tool induced force while said sleeve piston remains static within said housing means.

* * * * *